United States Patent [19]

Auer et al.

[11] Patent Number: 4,743,030

[45] Date of Patent: May 10, 1988

[54] WATER GUN AND TARGET COMBAT GAME SET

[75] Inventors: Robert T. Auer, East Stroudsburg, Pa.; Richard L. Keats, Sands Point, N.Y.

[73] Assignee: Buddy L Corporation, New York, N.Y.

[21] Appl. No.: 903,151

[22] Filed: Sep. 3, 1986

[51] Int. Cl.[4] ..... A63B 71/02; F41B 9/00; F41J 5/00

[52] U.S. Cl. ..... 273/349; 222/79; 434/327

[58] Field of Search ..... 273/349, 378, 346, 347; 222/79; 434/22, 19, 23, 327, 328, 329, 331

[56] References Cited

U.S. PATENT DOCUMENTS

| | | | |
|---|---|---|---|
| 2,938,512 | 5/1960 | Smolen | 273/349 X |
| 3,190,654 | 6/1965 | Ross | 273/378 |
| 3,454,344 | 7/1969 | Ryan et al. | 273/378 X |
| 3,508,344 | 4/1970 | Thomas | 434/327 |
| 4,022,350 | 5/1977 | Amron | 222/79 |
| 4,487,583 | 12/1984 | Brucker et al. | 434/22 |
| 4,653,582 | 3/1987 | Ehrenfried | 273/346 X |

FOREIGN PATENT DOCUMENTS 6214 of 1896 United Kingdom ..... 273/347

OTHER PUBLICATIONS

Washington Post, 12/29/85, Commando-Style Water Gun.

*Primary Examiner*—Paul E. Shapiro
*Attorney, Agent, or Firm*—Michael Ebert

[57] ABSTRACT

A simulated combat game set in which the players are provided with toy water guns and each player wears a target. When a gun is fired by a player it shoots out a beam of water, each player trying to hit a vulnerable site on the target worn by an opposing player and thereby strike him out. To this end, the vulnerable site on the target is constituted by a plaque or label having printed thereon a strike symbol or other hit indicator covered by a mask that conceals the indicator. The hit indicator is rendered readable only when the mask is made wet and transparent by a water beam impinging thereon.

4 Claims, 2 Drawing Sheets

Fig. 1.
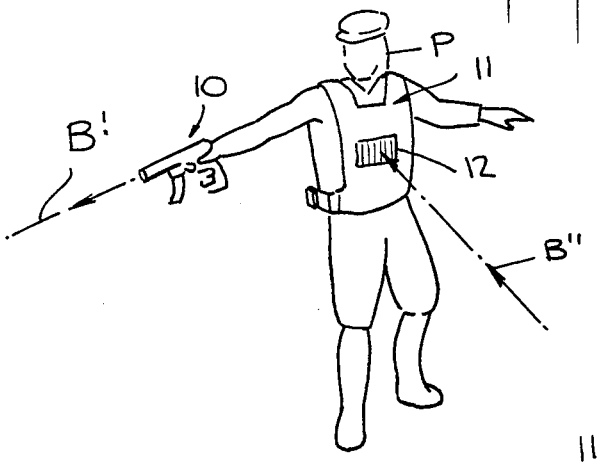
Fig. 2.
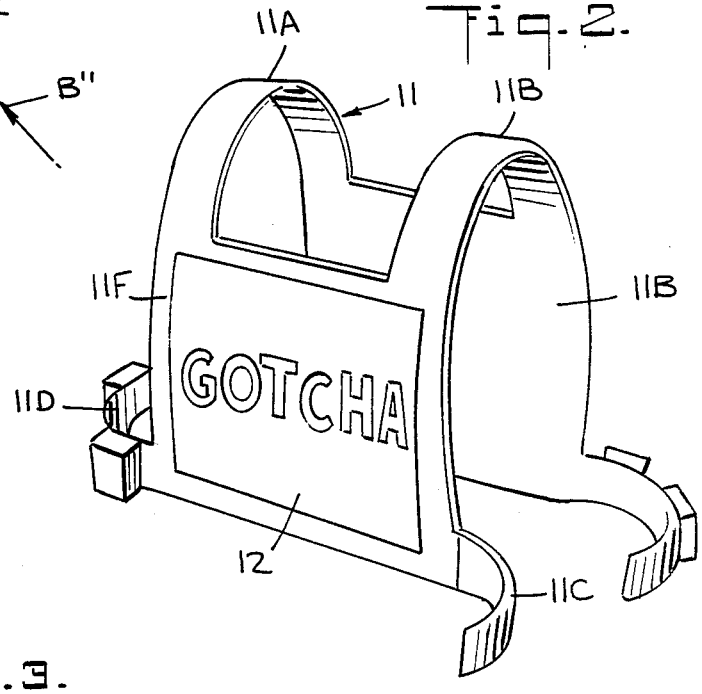
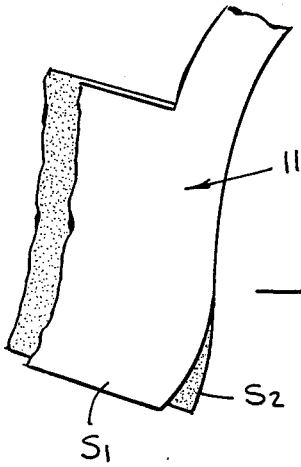
Fig. 3.
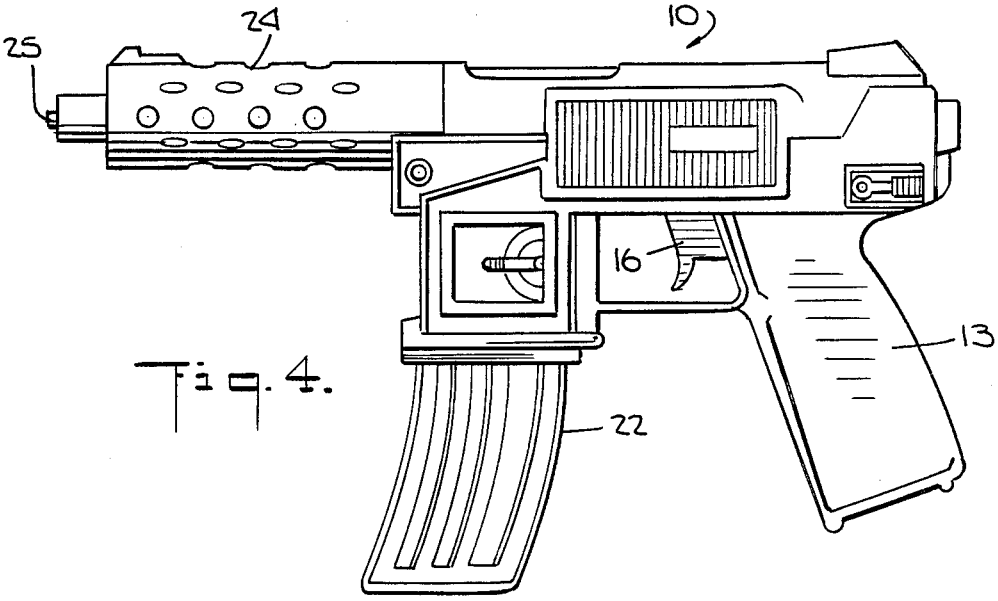
Fig. 4.

WATER GUN AND TARGET COMBAT GAME SET

BACKGROUND OF INVENTION

1. Field of Invention:

This invention relates generally to a simulated combat game set in which a toy water gun projects a water beam or stream toward a target, and in particular to a combat game set in which each player wears a target vest having a vulnerable site thereon that when struck and wet by water fired from a gun then registers a hit.

2. Status of Prior Art:

It is sometimes maintained that man is combative by nature, and the reason a competitive sport such a football is popular is because it affords the players and those watching the game a sublimated outlet for hostility and aggression, and therefore a healthy substitute for actual combat.

But whatever explanation is advanced for the appeal of competitive games, the fact remains that children have always enjoyed games which simulate combat, such as cops and robbers, cowboys and Indians, and in recent years, space warriors.

In any such children's game, the players are armed with toy weapons that are capable, when fired, of hitting another player who assumes the role of an enemy and is therefore a target. These toy guns must, of course, be innocuous; hence the projectile fired thereby may take the form of arrows tipped with suction cups rather than points, small soft balls made of foam plastic, or any other missile that can be fired to strike an enemy player without inflicting injury. Or the toy weapon may be of the type which projects a laser or light beam, or a beam or stream of water.

In order for a competitive combat game to be effective with children and have sustaining play value, it must simulate combat reality as understood by children whose concept of reality is usually gleaned from TV shows and motion pictures. Children recognize that in real combat when an enemy soldier is shot, this event is registered by the soldier falling to the ground or by some other action indicating that he is disabled and, as it were, hors de combat.

In the mythology of warfare there is one recurring theme. This theme centers on the existence of a seemingly invincible warrior who is vulnerable at only one site. Thus, the biblical warrier Samson possessed incredible strength, yet he could be robbed of strength by shearing off his hair and by no other means. Among the Greeks at ancient Troy, the greatest warrior was Achilles whose only site of vulnerability was at his heel. And even the great knight, Sir Galahad, had a chink in his armor. To update this myth, we now have police officers who wear bullet proof vests, but a vest of this type can be penetrated at some site by a high velocity bullet.

This mythological theme is not absent in modern children's games which simulate combat. Thus U.S. Pat. No. 4,487,583 discloses a toy which when fired projects a laser beam in the direction in which the gun is pointed. The target takes the form of a vest worn by a player and is provided at certain vulnerable sites with light sensors. Thus, merely striking the vest does not score a hit. To effectively hit a player, the light beam must be projected to impinge on a light sensor, in which event the resultant signal activates a hit indicator to register a hit. Thus, the Achilles heel of the player wearing this vest is at the light sensor thereon.

The problem with laser or light beam toy guns is that they fail to satisfy a child's craving for a toy weapon that simulates reality so that when fired it shoots out a tangible object. Light has no physical substance and is altogether silent, and it is for this reason that known toy light guns often include devices to produce, when the trigger is pulled, a noise burst so that the child operating the trigger has the sensation of doing more than closing a silent light switch.

The concern of the present invention is that with toy motorized water guns which project a beam of water and thereby satisfy a child's desire to shoot out something tangible when the gun is fired. Thus, U.S Pat. No. 4,022,350 discloses a water gun in which a battery-powered motor drives a pump that draws water from a reservoir and forces it through the gun barrel to be discharged from a nozzle. When the motor and pump are energized, intake and exit valves then act to periodically interrupt the flow of water, as a result of which the projected water beam is formed by a series of water pulses. This action is comparable to the action of an automatic machine gun which, when the trigger is pulled, fires a rapid succession of bullets.

When a water gun of the type disclosed in this patent is used in a simulated combat game, a hit is scored if the player firing the gun succeeds in striking another player with the projected water beam. But this falls short of what is desirable in such a game, for it takes little skill to strike a relatively large target constituted by a player3 s body. What is called for in order to make the game more interesting and to impart greater play value thereto is a target having a site of vulnerability thereon, or an Achilles heel that takes a fair degree of skill to strike. Thus, with practice some players will find it easier to strike the site than others, and this difference in the skills of the players will act to enhance the competitive nature of the game.

It is not enough, however, in the context of a water gun game to provide a target having a site of vulnerability thereon or a "bull's eye," for it is also necessary when a player succeeds in striking this site that this event be registered in some distinct way. In the case of a dart game, this represents no problem; for when the dart is thrown so that it pierces the bull's eye, this event is made evident by the presence of the dart in the bull's eye.

But with a water gun game, when a beam of clear water is projected toward a target, one cannot easily tell what part of the target is wet and therefore represents the site at which the beam has impinged thereon.

SUMMARY OF INVENTION

In view of the foregoing, the main object of this invention is to provide a simulated combat game set in which the players are equipped with motorized water guns and wear a target vest having a vulnerable site thereon which when struck by a projected water beam and made wet, then visibly registers a hit. While motorized water guns are preferred, the invention can also be carried out with conventional toy water guns which are manually operated to shoot out a stream of water.

More particularly, an object of this invention is to provide a game set of the above type in which the motorized water gun has a handle and a removable ammunition clip, the handle serving to house batteries for powering the pump motor and the clip serving as a reservoir for the water, so that while the gun resembles a conventional weapon, it functions as a water gun.

Also an object of the invention is to provide a target in the form of a player vest which is reversible, the vest having a different color on each side so as to identify the player's team allegiance by the exposed color of his vest.

Briefly stated, these objects are attained in a simulated combat game set in which the players are provided with toy water guns and each player wears a target. When a gun is fired by a player it shoots out a beam of water, each player trying to hit a vulnerable site on the target worn by an opposing player and thereby strike him out.

To this end, the vulnerable site on the target is constituted by a plaque or label having printed thereon a strike symbol or other hit indicator covered by a mask that conceals the indicator. The hit indicator is rendered readable only when the mask is made wet and transparent by a water beam impinging thereon.

OUTLINE OF DRAWINGS

For a better understanding of the invention as well as other objects and further features thereof, reference is made to the following detailed description to be read in conjunction with the accompanying drawings, wherein:

FIG. 1 shows a player equipped with a toy motorized water gun and target combat game set in accordance with the invention;

FIG. 2 is a separate perspective view of the target which is in the form of a vest worn by the player;

FIG. 3 is a detail of the vest;

FIG. 4 is a separate side view of the water gun;

DESCRIPTION OF INVENTION

Figure 6:
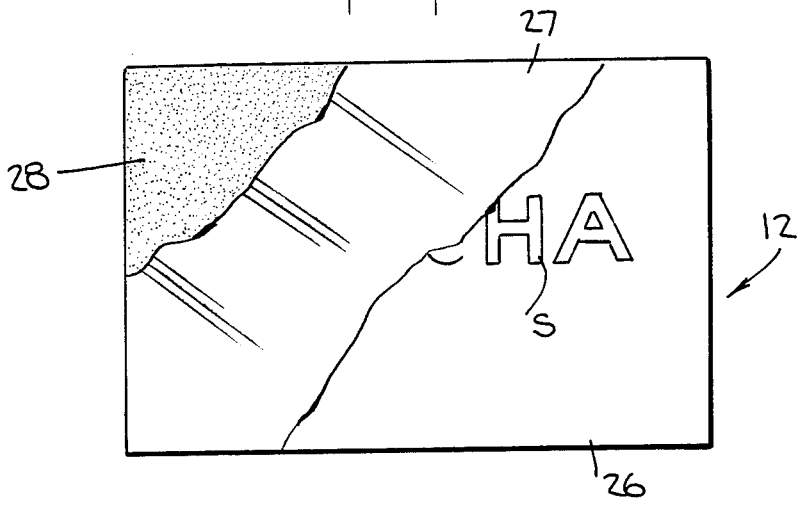
FIG. 6 shows, in a partly cut away view, the structure of the plaque on the vest.

Referring now to FIGS. 1 and 2, a combat game set in accordance with the invention consists of a toy motorized water gun, generally designated by numeral 10, which is grasped by a player P and when fired projects a beam B' of water in the direction in which the gun is pointed, and a target vest, generally designated by numeral 11, provided with a vulnerable site in the form of a plaque 12 secured to the front panel 11F of the vest which has a rear panel 11R.

The nature of plaque 12 is such that when an opposing player who also is armed with a gun shoots a water beam B" in the direction of player P and the gun is so aimed as to cause beam B" to impinge on plaque 12, this plaque which when dry appears to be blank, as shown in FIG. 1, when wet by the beam then displays a strike symbol S. This symbol, by way of example, is shown in FIG. 2 as the term "GOTCHA." But in practice, it may be HIT, a bull's eye, a stylized explosion or any other graphic display that represents a strike and therefore registers a hit or kill.

Each player is provided with a game set consisting of water gun 10 and target vest 11; hence in order to play a combat game, at least two players are required. In practice, where a large number of players and game sets are available, the players can then be divided into opposing teams each having its own team color. To this end, vest 11 is fabricated of two interlaminated plastic plies $S_1$ and $S_2$ in different colors such as red and blue. The vest is reversible so that when worn on one side, it presents a red color representing one team, and when worn on the other side it presents a blue color representing the opposing team. With a reversible vest of this type, a plaque 12 must be attached to both the front face and the rear face of front panel 11F.

The rear panel 11R of the vest shown has no plaque thereon, so that when a player is struck in the back by a water beam, this does not count as a hit. But in practice, one may provide plaques on both the front and rear panels of the vest.

As shown in FIG. 2, the vest includes shoulder straps 11A and 11B which join the front and rear panels 11F and 11R, and adjustable waist straps 11C and 11D for encircling the waist of the player and holding the vest panels securely against the chest and back of the player.

Figure 5:
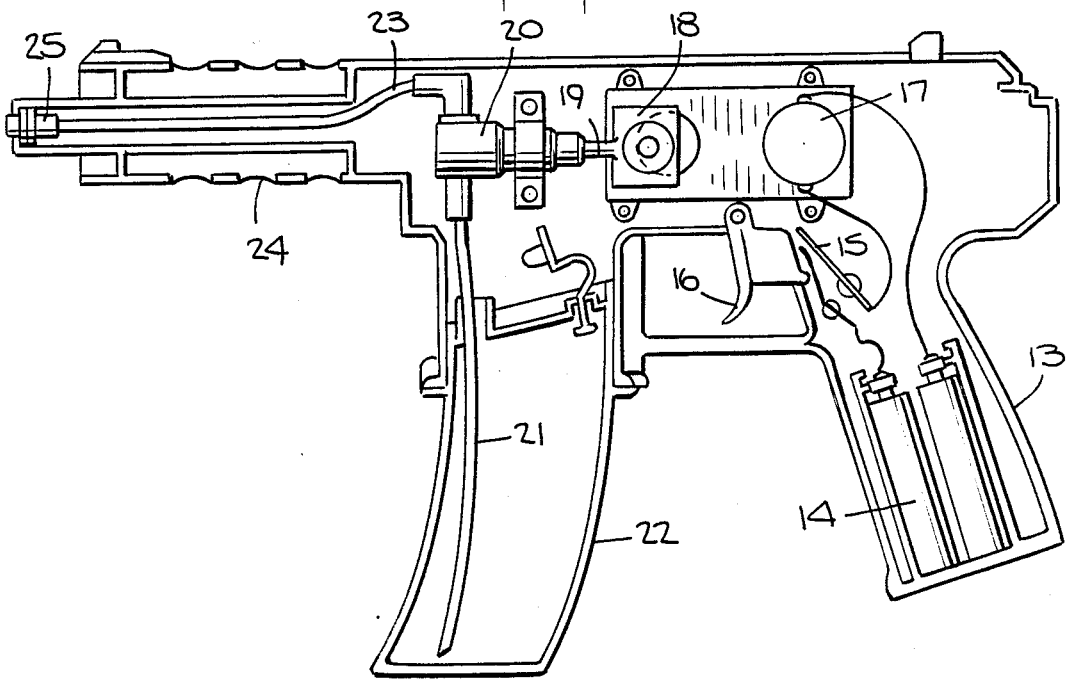
FIG. 5 is a section taken through the gun.

Gun 10, as shown in FIGS. 4 and 5, includes a hollow handle 13 which houses batteries 14. These are connected through a switch 15 operated by a trigger 16 to a direct-current motor 17. Motor 17 is coupled via a gear reduction box 18 to a valve plunger push rod 19 operatively coupled to a spring-loaded piston pump 20. Pump 20 draws water into its inlet through a syphon tube 21. Tube 21 is immersed in a water reservoir formed by a detachable water supply clip 22 which resembles a conventional ammunition clip.

The outlet of pump 20 is coupled to a water outlet tube 23 which extends through the barrel 24 of the gun and terminates in a nozzle 25. In operation, when the trigger is pulled, this acts to energize the motor which drives the water pump and actuates water input and exit valves to force periodic pulses of water into outlet tube 23. As a result, projecting from nozzle 25 is a water beam formed by a series of water spurts. The reciprocating action of the valves to effect water pulsing may be made deliberately noisy, so that the player has the sensation of shooting off a rapid series of bullets.

Plaque 12, as shown separately in FIG. 6, is composed of a base sheet 26 formed of PVC or Mylar on which is printed the hit symbol which in the example given is GOTCHA. Laminated onto base sheet 26 is a cover sheet 27 of transparent plastic film material. The base sheet may be any suitable flexible sheet, or open mesh, or woven or non-woven fabric.

In order to make cover sheet 27 act as a mask which normally blanks out the strike symbol S, the surface of cover sheet 27 is coated with a layer 28 constituted by a dispersion of extremely fine acrylic silicate particles in the micron range. When dry, this layer of particles acts to diffuse incident light and to render the transparent cover sheet 27 translucent; that is, the cover sheet now admits and diffuses light so that objects or printing behind this sheet cannot be clearly distinguished and the cover sheet then functions effectively as a mask.

When, however, layer 28 is made wet by an impinging water beam, the resultant film of water which fills the interstices between the fine particles serves as an anti-diffusing agent and acts effectively to remove the mask and render the cover sheet transparent to expose the strike symbol.

In play, once a player is struck by a water beam by an opponent on the target plaque or vulnerable site, this event is registered by the strike symbol which is then displayed, and the player is out of the game. Thus, if the combat game is played by two teams, each having 5 players, and the game is timed to run for a 15 minute period within a marked off playing field having a center dividing line between the two teams, then the team which has the largest number of surviving players after this period wins the game.

But the players can make up their own rules of play. For example, if the vest has front and rear plaques, the rules could provide that a front plaque strike is a kill and the player is out of the game; whereas a rear plaque strike "wounds" the player who can then only fire, say, three more times.

While there has been shown and described a preferred embodiment of a water gun and target combat game set in accordance with the invention, it will be appreciated that many changes and modifications may be made therein without, however, departing from the essential spirit thereof.

Thus the target, instead of being in the form of a reversible vest formed of two-ply material of different colors, may be formed of single ply material in which the front panel is in one color and the rear panel is in another color. In this instance, either panel can be worn against the chest to identify the team of the player. Or the target may be in ordinary bib or T-shirt form having a label or plaque sewn or otherwise affixed thereon to provide the vulnerable side. And instead of covering the printed strike symbol with a masking layer as disclosed above, one may use as a layer for this purpose the mask disclosed in the context of a diaper in U.S. Pat. No. 4,192,311; which mask when dry renders an indicator underlying the mask invisible, and when wet unmasks the indicator. Whatever the nature of the mask, when it dries out, it becomes opaque again, so that the plaque is reversible.

We claim:

1. A combat game set comprising:

A. a battery-powered toy water gun having a water pump operated by a direct-current motor connected to the battery by a trigger-actuated switch which when fired by a trigger operation shoots out a beam of ordinary water; and B. a target wearable by the player having a plaque thereon constituted by a base sheet having a strike symbol printed thereon which is concealed by a masking layer formed by a cover sheet laminated to said base sheet which when dry is effectively opaque and is effectively rendered transparent to expose the symbol only when the making layer is rendered wet by the water beam whereby the exposed strike symbol indicated a hit, said target being dimensioned to shield from water a relatively large area of the player's body, said masking layer, when thereafter dry, again concealing the strike symbol whereby the plaque is repeatedly reusable, said cover sheet being formed by a transparent sheet whose outer surface is coated with a dispersion of fine acrylic silicate particles that diffuse light when dry, and are rendered transparent when wet.

2. A game as set forth in claim 1, wherein said gun produces a water beam formed by a series of water pulses.

3. A game as set forth in claim 1, wherein said gun is provided with a barrel, a handle and an ammunition clip and has a battery-operated motor which drives a water pump that draws water from a reservoir when the trigger is actuated and forces the water through an outlet tube in the barrel of the gun terminating in a nozzle from which the beam is discharged.

4. A game as set forth in claim 3, wherein the battery is disposed in said handle.

* * * * *